US007341547B2

(12) United States Patent
Liao

(10) Patent No.: US 7,341,547 B2
(45) Date of Patent: Mar. 11, 2008

(54) ABDOMINAL EXERCISE MACHINE

(75) Inventor: Hsueh-Hu Liao, Shenzhen (CN)

(73) Assignee: HL Copr(Shen Zhen), Shenzhen (CN)

( * ) Notice: Subject to any disclaimer, the term of this patent is extended or adjusted under 35 U.S.C. 154(b) by 0 days.

(21) Appl. No.: 11/423,431

(22) Filed: Jun. 10, 2006

(65) Prior Publication Data

US 2007/0135281 A1 Jun. 14, 2007

(30) Foreign Application Priority Data

Dec. 12, 2005 (CN) ..... 2005 2 0142997

(51) Int. Cl.
*A63B 26/00* (2006.01)

(52) U.S. Cl. ..... 482/140

(58) Field of Classification Search ..... 482/140, 482/907, 126, 136
See application file for complete search history.

(56) References Cited

U.S. PATENT DOCUMENTS 6,036,624 A * 3/2000 Cascini ..... 482/97
6,592,500 B1 * 7/2003 McBride et al. ..... 482/140

* cited by examiner

*Primary Examiner*—Lori Amerson

(57) ABSTRACT

An abdominal exercise machine includes a U-shaped base, a head member, two first mounting members, and two handles. The base includes a main portion, and two arm portions extending from opposite ends of the main portion. The head member is mounted to main portion of the base. The first mounting members are mounted to corresponding arm portions of the base. A plurality of locating portions is formed on each of the first mounting members. Each of the mounting members has an arc-shaped edge. The handles are rotatably mounted to the corresponding mounting members. The handles are selectively mounted to the location portions of the corresponding first mounting members.

17 Claims, 5 Drawing Sheets

ABDOMINAL EXERCISE MACHINE

BACKGROUND OF THE INVENTION

The present invention relates to exercise machines, and particularly to an abdominal exercise machine for exercising the abdominal muscles.

Currently, a variety of exercise equipments have been developed to exercise abdominal muscles.

A general abdominal exercise machine includes a U-shaped base, a head member fitting about a middle of the base, a back member connecting with a side of the head member, and two handles extending up from opposite ends of the base. An arc-shaped portion is formed at a distal end of each handle. A distal end of each arc-shaped portion is inward bent to form an operating part, for being held by a corresponding hand of an exerciser. In use, the exerciser lies on the back member. Hands of the exerciser hold the operating parts of the handles. The exercise machine moves together with the exerciser. The exercise machine rotates around the arc-shaped portions when the arc-shaped portions touch the ground. The exercise machine can help people lose some weight. However, the handles extend up from the base, which needs a great space to place the exercise machine. It is not easy to receive and keep the exercise machine.

What is needed is to abominal exercise machine includes a U-shaped base, a exercising the abominal muscles.

BRIEF SUMMARY OF TH INVENTION

An exemplary abdominal exercise machine includes a U-shaped base, a head member, two first mounting members, and two handles. The base includes a main portion, and two arm portions extending from opposite ends of the main portion. The head member is mounted to the main portion of the base. The first mounting members are mounted to corresponding arm portions of the base. A plurality of locating portions is formed on each of the first mounting members. Each of the mounting members has an arc-shaped edge. The handles are rotatably mounted to the corresponding first mounting members. The handles are selectively mounted to the location portions of the corresponding first mounting members.

Other objects, advantages and novel features of the invention will become more apparent from the following detailed description when taken in conjunction with the accompanying drawings, in which:

DETAILED DESCRIPTION OF THE INVENTION

Figure 1:
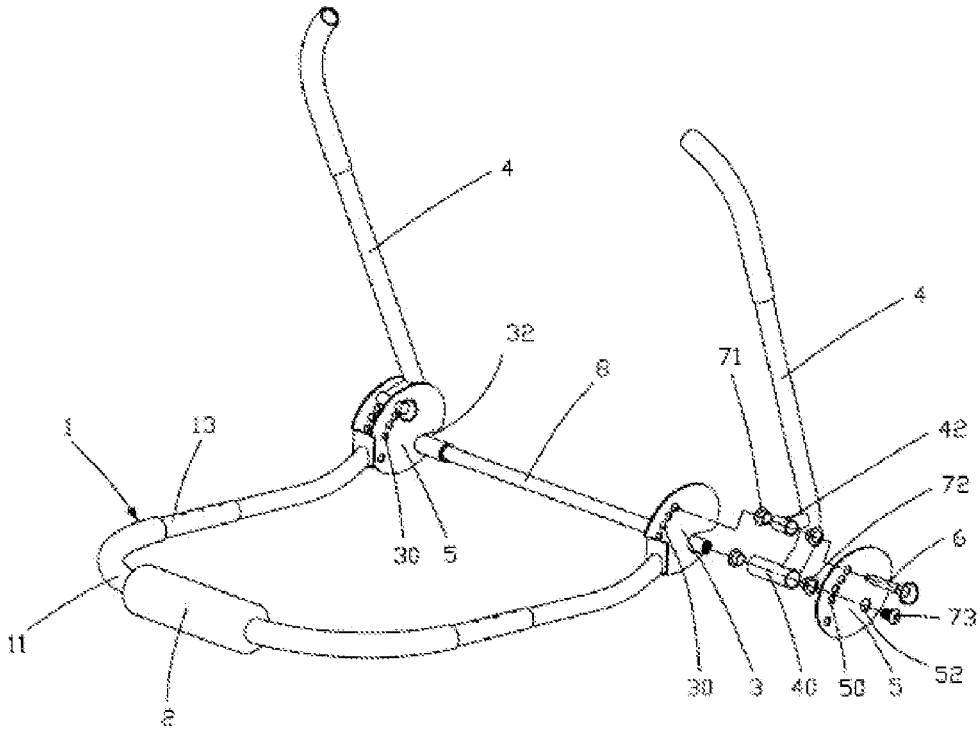
FIG. 1 is an exploded, isometric view of an abdominal exercise machine in accordance with a preferred embodiment of the present invention, the exercise machine includes a base, and a pair of handles.

Referring to FIG. 1, an abdominal exercise machine in accordance with a preferred embodiment of the present invention includes a base 1, a head member 2 fitting about the base 1, two first mounting plates 3 mounted at opposite ends of the base 1, two handles 4, two second mounting plates 5, and two fasteners 6.

The base 1 having a U shape includes a main portion 11, and two arm portions 13 extending perpendicularly from opposite ends of the main portion 11.

The head member 2 fits about the main portion 11 of the base 1. The head member 2 is made of elastic material, such as sponge, bubble film, and so on. The head member 2 provides a support for supporting a head of an exerciser.

Each first mounting plate 3 has a general circular shape. Each first mounting plate 3 includes a plurality of locating portions 30. In this embodiment, the locating portions 30 are a plurality of first locating holes defined in each first mounting plate 3 and along a side of the first mounting plate 3. A cutout 32 is defined in the first mounting plate 3 opposite to the first locating holes 30. Two opposite ends of a connecting member 8 are received in the corresponding cutouts 32 of the two mounting plates 3. A threaded hole (not labeled) is defined in each end of the connecting member 8.

Each handle 4 has a pole shape. A lower portion of each handle 4 has an arc shape. A pivot portion 40 defining a pivot hole (not labeled) therein is formed at a distal end of the handle 4. A connecting portion 42 defining a through-hole (not labeled) therein is formed at the handle 4 and upper to the pivot portion 40.

Each second mounting plate 5 defines at least one second locating hole 50 therein. A through-hole 52 is defined in the second mounting plate 5 opposite to the at least one second locating hole 50.

Figure 2:
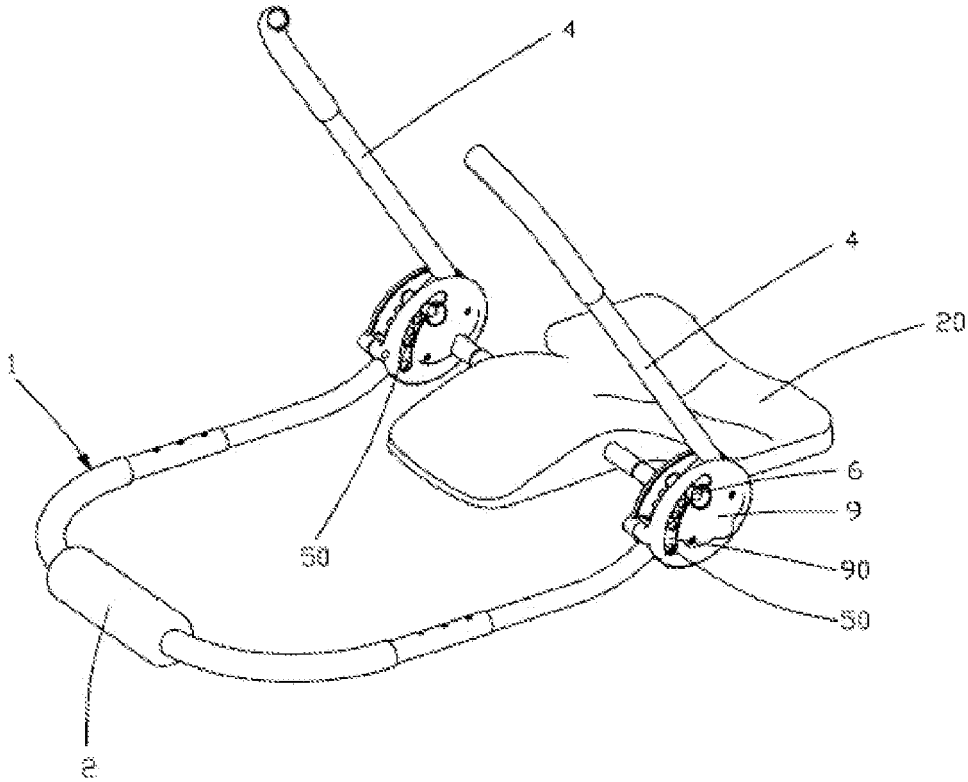
FIG. 2 is an assembled view of FIG. 1, together with a seat member.
Figure 3:
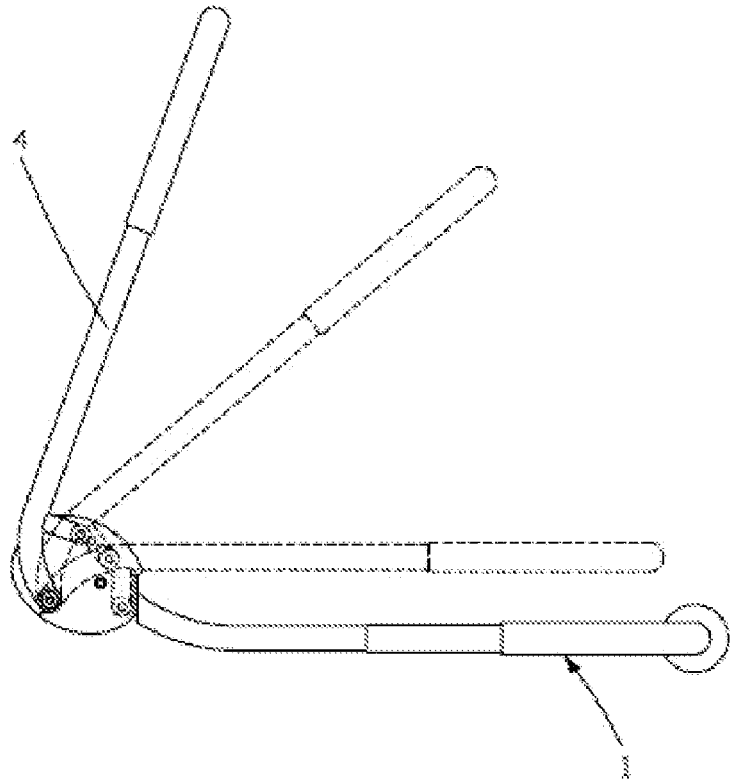
FIG. 3 is a rear side elevational view of the abdominal exercise machine of FIG. 2, showing the handles in different positions.
Figure 4:
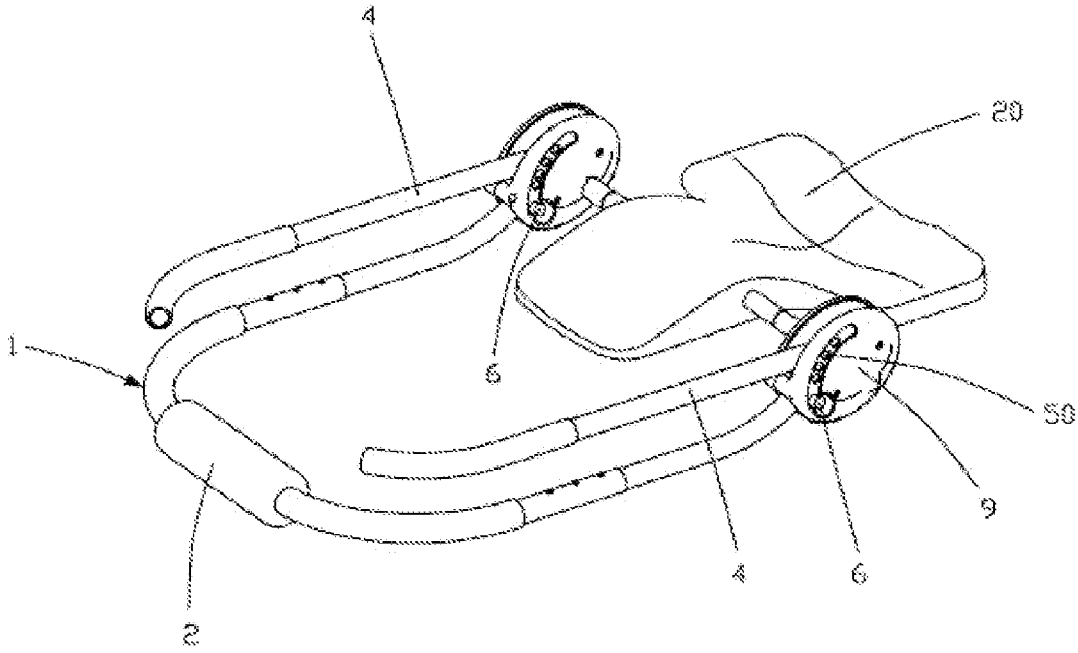
FIG. 4 is similar to FIG. 2, showing the handles being folded.

Referring also to FIGS. 2 to 4, in assembly, each fastener 6, such as a pin is inserted through the second locating hole 50 of a corresponding second mounting plate 5, a first sleeve of a pair of sleeves, the through-hole of the connecting portion 42 of a corresponding handle 4, a second sleeve of the pair of sleeves, and a corresponding first locating hole 30 of a corresponding first mounting plate 3, to assemble the corresponding handle 4 between the first and second mounting plates 3, 5. A corresponding end of the connecting member 8 is inserted into the pivot hole of the pivot portion 40 of the corresponding handle 4. A screw 73 is inserted through the through-hole 52 of a corresponding second mounting plate 5, a first sleeve of a pair of sleeves 71, the pivot hole of the pivot portion 40 of the handle 4, and a second sleeve of the pair of sleeves 71, to engage in the corresponding threaded hole of the connecting member 8. The handles 4 can rotate round the corresponding pivot portions 40. The second locating hole 50 of the second mounting plate 5 aligning with different first locating holes 30 of the first mounting plate 3 can form different gradients between the corresponding handle 4 and the base 1. The handle 4 can be folded with the base 1 when the second locating hole 50 aligns with the lowest first locating hole 30. The connecting member 8 can strengthen the structure of the abdominal exercise machine. A back member 20 is mounted to a middle portion of the connecting member 8.

A shell 9 is mounted at an outer surface of each of the first and second mounting plates 3, 5. Each shell 9 has a circular shape. At least one opening 90 is defined in each shell 9 for exposing the corresponding first or second locating holes 30, 50. The shells 9 can prevent dust, and please the eyes.

Figure 5:
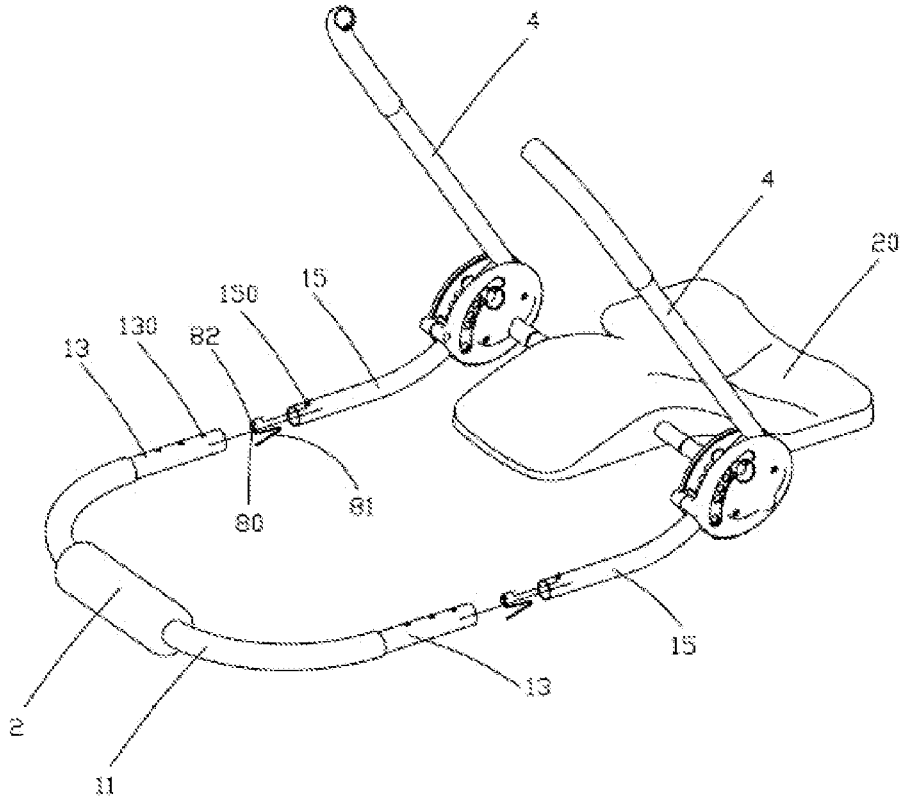
FIG. 5 is similar to FIG. 2, with the base partially exploded.
Figure 6:
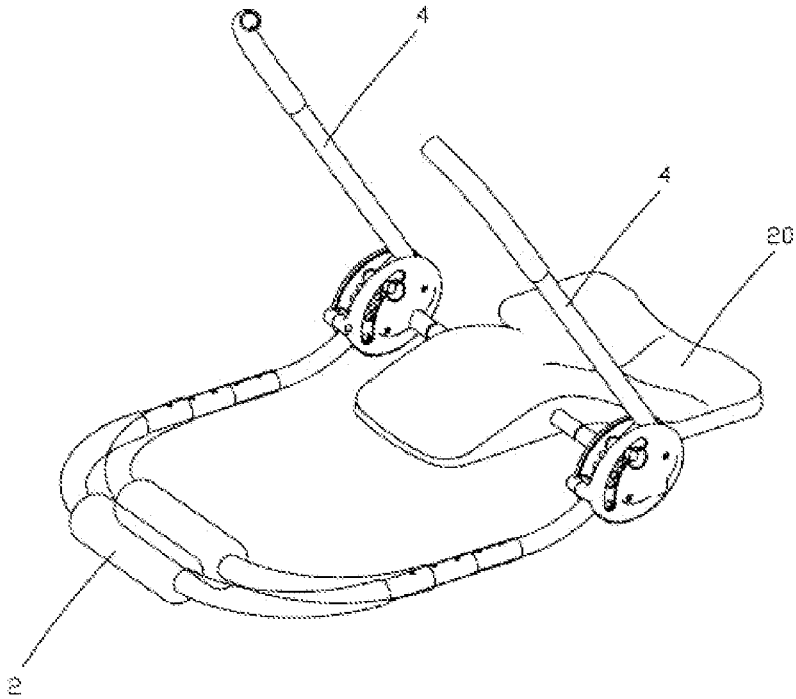
FIG. 6 is an assembled view of FIG. 5, showing the base in different positions.
Figure 7:
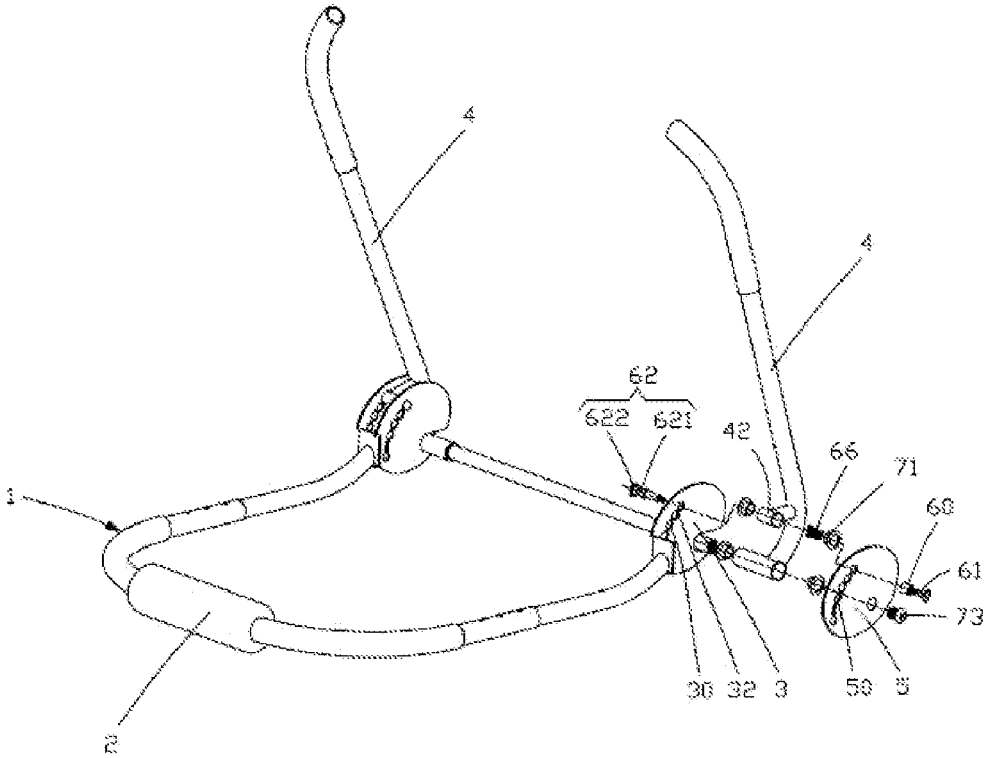
FIG. 7 is an exploded, isometric view of an abdominal exercise machine in accordance with an alternative preferred embodiment of the present invention, the exercise machine includes a pair of handles.
Figure 8:
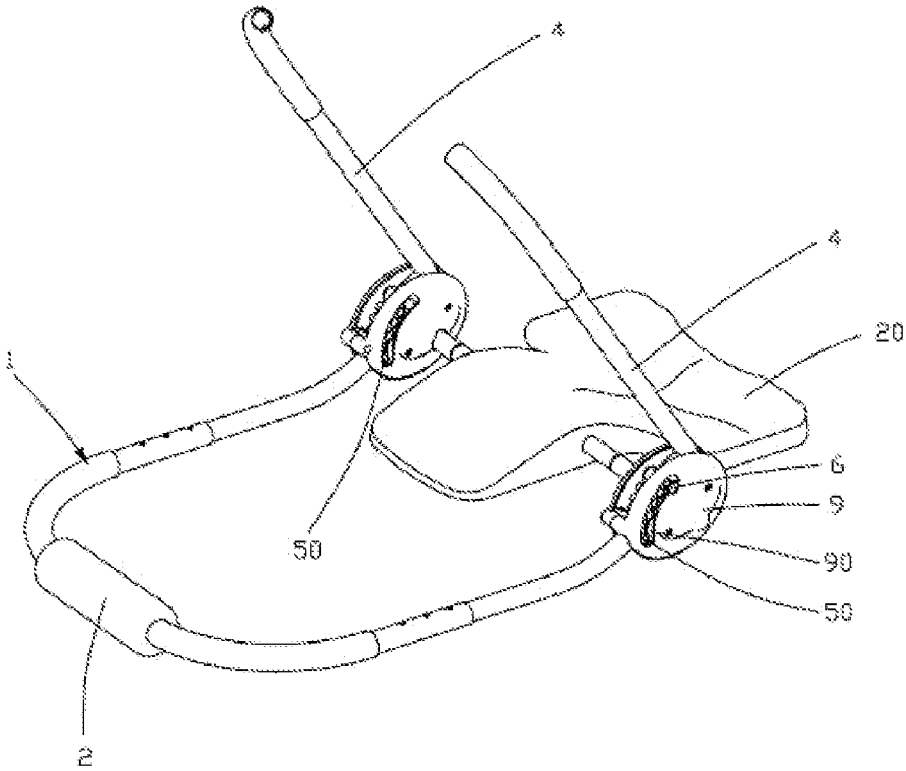
FIG. 8 is an assembled view of FIG. 7.
Figure 9:
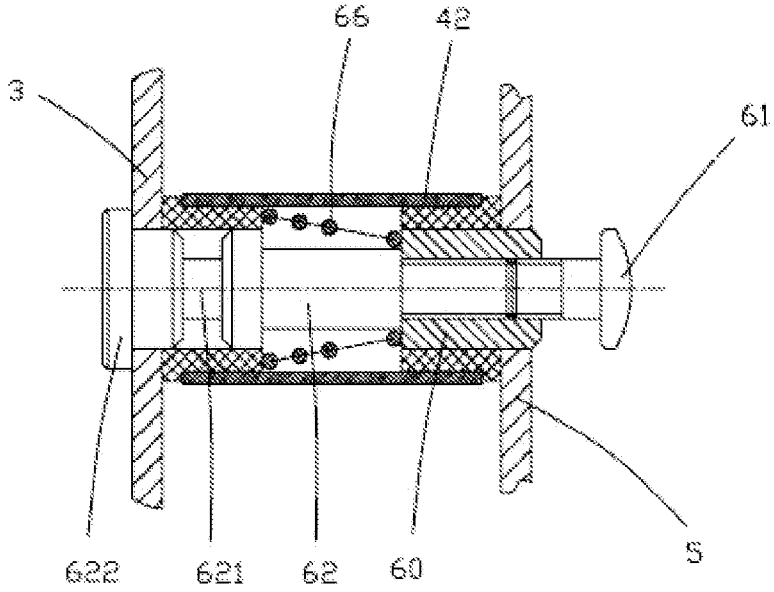
FIG. 9 is a cross-sectional view of FIG. 3.
Figure 10:
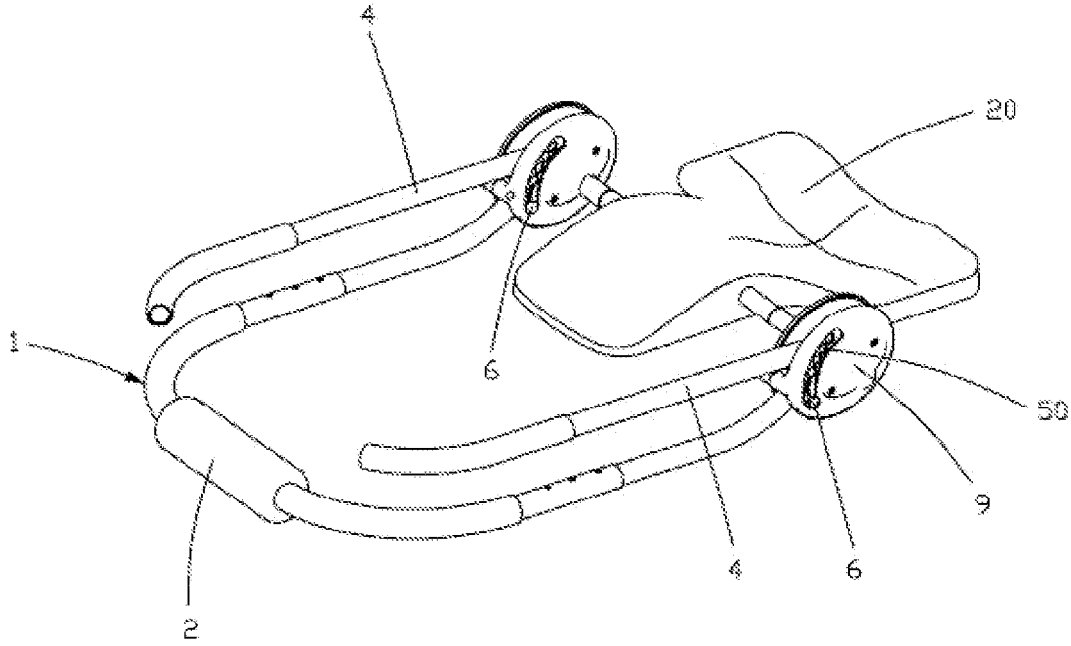
FIG. 10 is similar to FIG. 8, showing the handles being folded.

Referring also to FIGS. 5 and 6, and extension member 15 is mounted to a corresponding arm portion 13 of the base 1. A plurality of first locking holes 130 is defined in each arm portion 13. A second locking hole 150 is defined in each extension member 15. A fixing member 80 is inserted through the second locking hole 150 of a corresponding extension member 15 to engage in the corresponding first locking hole 130 of base 1, to fix the extension member 15 to the base 1. The fixing member 80 includes an elastic member received in the extension member 15, and a protruding pin connected to the elastic member. The elastic member may be a line spring, a helix spring, or a spring tab, etc. The second locking hole 150 aligns with a corresponding first locking hole 130. The protruding pin 82 engages with a corresponding first locking hole 130 and the second locking hole 150, to assemble the extension member 15 to a corresponding arm portion 13 of the base 1. When adjusting the length of the extension member 15, the protruding pin is pressed to draw back to disengage from the corresponding first locking hole 130. The extension member 15 moves along the arm portion 13, till the second locking hole 150 of the extension member 15 aligns with another first locking hole 130. The protruding pin 82 engages in the corresponding first locking hole 130. Thus, the extension member 15 can be mounted to different positions of the arm portion 13 to fit different statures of the exercises.

Referring also to FIGS. 7-10, an abdominal exercise machine in accordance with an alternative preferred embodiment of the present invention is shown. The abdominal exercise in this embodiment has a general similar structure to the above mentioned abdominal exercise machine. A slot is defined in the corresponding first mounting plate 3. A plurality of neck portions 32 is formed along the slot. Locating portions 30 are formed between each two adjacent neck portions 32. At least one through-hole 50 is defined in the second mounting plate 5. Each fastener in this embodiment includes a screw tube 60 received in the connecting portion 42 of the handle 4, a pressing member 61 engaged with a corresponding end of the screw tube 60, and a locking member 62. The locking member 62 includes a first portion 621 having an external diameter less than or equal to a width of each of the neck portions 32, and a second portion 622 formed at an end thereof. The second portion 622 has an external diameter greater than the width of each of the neck portions. An external diameter of the locking member 62 between the first portion 621 and the second portion 622 is greater than the width of each neck portion 32. A resilient member 66 is received in the connecting portion 42 of a corresponding handle 4, and between the pair of sleeves 71.

In assembly, each screw tube 60 is located between a corresponding first mounting plate 3, and a second mounting plate 5. Each pressing member 61 is inserted through the through-hole 50 of the second mounting plate 5, to engage in the screw tube 60. The resilient member 66 is elastically depressed by the sleeve 71 and the screw tube 60. The resilient member 66 can be directly depressed by the first mounting plate 3 when the sleeve 71 is saved. When adjusting each handle 4, the corresponding pressing member 61 is pressed toward a corresponding first mounting plate 3. The first portion 621 of the locking member 62 aligns with the slot of the first mounting plate 3. The handle 4 is rotated. The first portion 621 of the locking member 62 passes through a corresponding neck portion 32. When the handle 4 rotates to a proper degree, the pressing member 61 is released. The resilient member 66 is elastically rebound. The first portion 621 is disengaged from the slot. The second portion 622 of the locking member 62 touches the first mounting plate 3. The external diameter of the locking member 62 between the first portion 621 and the second portion 622 being greater than the width of each neck portion 32 cannot pass through the neck portion 32. Thus, the handle 4 is oriented.

In other embodiment, the second mounting plate 5 is saved. The fastener is inserted through the connecting portion 42 of a corresponding handle 4, to engage in a corresponding first locating hole 30 of the corresponding first mounting plate 3.

It is believed that the present embodiments and their advantages will be understood from the foregoing description, and it will be apparent that various changes may be made thereto without departing from the spirit and scope of the invention or sacrificing all of its material advantages, the examples hereinbefore described merely being preferred or exemplary embodiments of the invention.

What is claimed is:

1. An abdominal exercise machine, comprising:

a U-shaped base comprising a main portion, and two arm portions extending from opposite ends of the main portion;

a head member mounted to the main portion of the base;

two first mounting members mounted to corresponding arm portions of the base, a plurality of locating portions formed on each of the first mounting members, each of the mounting members having an arc-shaped edge;

two second mounting members paralle to the corresponding first mounting members; and two handles rotatably mounted to the corresponding first mounting members and located between the corresponding first and second mounting members, the handles selectively pivotably mounted to the location portions of the corresponding first mounting members.

2. The abdominal exercise machine as claimed in claim 1, wherein said locating portions comprise a plurality of locating holes defined in each of the first mounting members, a second locking hole is formed on each of the second mounting members, corresponding to the first looking holes of the first mounting member.

3. The abdominal exercise machine as claimed in claim 2, wherein a connecting portion is formed at a lower portion of each of the handles, the connecting portion is mounted between the second locating hole of the corresponding second mounting member and a corresponding first locating hole of the corresponding first mounting member.

4. The abdominal exercise machine as claimed in claim 3, wherein a through-hole is defined in the connecting portion of each of the handles, a fastener is inserted through the second locating hole, the through-hole, and a corresponding first locating hole to assemble the first mounting member, the handle and the second mounting member together.

5. The abdominal exercise machine as claimed in claim 4, wherein the first locating holes are defined along a side of each of the first mounting members.

6. The abdominal exercise machine as claimed in claim 3, wherein a slot is defined in each of the first mounting members, a plurality of neck portions is formed along the slot, the first locating holes are formed between every two adjacent neck portions, a through-hole is defined in the connecting portion of each of the handles, a fastener is inserted through the second locating hole, the through-hole, and a corresponding first locating hole to assemble the first mounting member, the handle and the second mounting member together.

7. The abdominal exercise machine as claimed in claim 6, wherein the slot is along a side of the corresponding first mounting member and has an arc shape.

8. The abdominal exercise machine as claimed in claim 7, wherein each of the fasteners comprises a screw tube located in the connecting portion of the handle, and between a corresponding first mounting member and a second mounting member, a pressing member inserted through the through-hole of the second mounting member to engage in the screw tube, and a locking member inserted through the slot of the first mounting member to engage in the screw tube.

9. The abdominal exercise machine as claimed in claim 8, wherein the locking member includes a first portion having an external diameter less than or equal to a width of each neck portion, and a second portion formed at an end thereof, an external diameter of the locking member between the first portion and the second portion is greater than the width of each neck portion, an external diameter of the locking member between the first portion and the second portion is greater than the width of each of the neck portions.

10. The abdominal exercise machine as claimed in claim 9, wherein a resilient member is received in the screw tube, and located between corresponding first and second mounting members.

11. The abdominal exercise machine as claimed in claim 3, wherein the lower end of each of the handles has an arc shape, a pivot portion is formed at a distal end of the arc-shaped end of each of the handles, the handle is rotatably mounted to the corresponding first mounting member via the pivot portion.

12. The abdominal exercise machine as claimed in claim 11, wherein a connecting member is mounted to lower portions of the first mounting members, two threaded holes are defined in opposite ends of the connecting member, the pivot portion of each of the handles defines a pivot hole therein, a through-hole is defined in each of the second mounting members, a screw is inserted through the through-hole of the corresponding second mounting member, the pivot hole of the corresponding handle, and engaged in the corresponding threaded hole of the connecting member.

13. The abdominal exercise machine as claimed in claim 12, wherein a back member is mounted to the connecting member.

14. The abdominal exercise machine as claimed in claim 1, further comprising two extension members, each of the extension members is mounted to a corresponding arm portion of the base; the corresponding first mounting member is mounted to the corresponding extension member.

15. The abdominal exercise machine as claimed in claim 14, wherein a plurality of first locking holes is defined in each of the arm portions of the base, a second locking hole is defined in each of the extension members, corresponding to the first locking holes of the corresponding arm portion, for each of the extension members being selectively mounted to different positions of the corresponding arm portion.

16. The abdominal exercise machine as claimed in claim 15, wherein each of the extension members is mounted to the corresponding arm portion via a fastener.

17. The abdominal exercise machine as claimed in claim 16, wherein each of the fixing members comprises an elastic member received in the corresponding extension member, and a protruding pin connected to the elastic member, the protruding pin is inserted through a corresponding first locking hole of the corresponding arm portion, to engage in the second locking hole of the extension member.

* * * * *